US011624290B2

(12) United States Patent
Gibson et al.

(10) Patent No.: US 11,624,290 B2
(45) Date of Patent: Apr. 11, 2023

(54) ANTI-CONING ASPIRATING FACE SEAL

(71) Applicant: General Electric Company, Schenectady, NY (US)

(72) Inventors: Nathan Evan McCurdy Gibson, West Chester, OH (US); Christopher Jon Potokar, Whitefish Bay, WI (US); Hariharan Manickavasagam Sarojini, Bangalore (IN); Arnab Sen, Bangalore (IN); Bikramjit Chatterjee, State College, PA (US)

(73) Assignee: General Electric Company, Schenectady, NY (US)

( * ) Notice: Subject to any disclaimer, the term of this patent is extended or adjusted under 35 U.S.C. 154(b) by 42 days.

(21) Appl. No.: 17/143,115

(22) Filed: Jan. 6, 2021

(65) Prior Publication Data

US 2021/0148243 A1 May 20, 2021

Related U.S. Application Data

(63) Continuation of application No. 16/129,218, filed on Sep. 12, 2018, now Pat. No. 10,900,369, which is a (Continued)

(30) Foreign Application Priority Data

Apr. 14, 2016 (IN) ..... 201641013072

(51) Int. Cl.
*F01D 11/02* (2006.01)

(52) U.S. Cl.
CPC ..... *F01D 11/025* (2013.01)

(58) Field of Classification Search
CPC ..... F01D 11/00; F01D 11/02; F01D 11/025; F01D 11/08; F01D 11/10; F01D 11/12
(Continued)

(56) References Cited

U.S. PATENT DOCUMENTS 5,284,347 A * 2/1994 Pope ..... F01D 11/06 277/411
5,975,537 A * 11/1999 Turnquist ..... F16J 15/443 277/411

(Continued)

OTHER PUBLICATIONS

Hwang et al., "Advanced seals for engine secondary flowpath," *Journal of Propulsion and Power* 12(4): 794-799, July-Aug. 1996.

(Continued)

*Primary Examiner* — Nathan Gumar

(74) *Attorney, Agent, or Firm* — Klarquist Sparkman, LLP

(57) ABSTRACT

An aspirating face seal between high and low pressure regions of a turbomachine at a juncture between rotatable and non-rotatable members of turbomachine includes gas bearing rotatable and non-rotatable face surfaces. Primary and starter seal teeth and optional deflector seal tooth are mounted on seal teeth carrier on rotatable member. Non-rotatable face surface is mounted on an annular slider on the non-rotatable member. A pull-off biasing means urges the annular slider away from the rotatable member and the non-rotatable face surface away from the rotatable surface. A secondary seal is in sealing engagement with the annular slider in the low pressure region and the pull-off biasing means is located radially outwardly of the annular slider in the high pressure region. Biasing means may include coil springs within spring chambers of circumferentially spaced cartridges. Tongues extend inwardly from spring chambers into grooves in slider.

19 Claims, 12 Drawing Sheets

Related U.S. Application Data continuation of application No. PCT/US2017/027096, filed on Apr. 12, 2017.

(58) Field of Classification Search
USPC ..... 277/409
See application file for complete search history.

(56) References Cited

U.S. PATENT DOCUMENTS

| | | | | |
|---|---|---|---|---|
| 6,676,369 | B2 * | 1/2004 | Brauer | F01D 11/025 415/113 |
| 6,758,477 | B2 * | 7/2004 | Brauer | F16J 15/164 277/379 |
| 8,256,575 | B2 * | 9/2012 | Berberich | F16C 33/74 310/90 |
| 2003/0184022 | A1 | 10/2003 | Brauer et al. | |
| 2003/0185669 | A1 | 10/2003 | Brauer et al. | |
| 2009/0051119 | A1 * | 2/2009 | Glahn | F16J 15/008 277/400 |
| 2012/0251290 | A1 * | 10/2012 | Turnquist | F01D 11/025 415/171.1 |
| 2014/0053394 | A1 * | 2/2014 | Cooper | F01D 25/24 29/726 |

OTHER PUBLICATIONS

International Search Report and Written Opinion issued in connection with corresponding PCT Application No. PCT/US2017/027096, dated Jun. 30, 2017.

International Preliminary Report on Patentability issued in connection with corresponding PCT Application No. PCT/US2017/027096, dated Oct. 16, 2018.

* cited by examiner

ANTI-CONING ASPIRATING FACE SEAL

CROSS REFERENCE TO RELATED APPLICATIONS

This application is a continuation of U.S. patent application Ser. No. 16/129,218, filed Sep. 12, 2018, which is a continuation of International Patent Application No. PCT/US2017/027096, filed Apr. 12, 2017, which claims the benefit of India Patent Application No. 201641013072, filed Apr. 14, 2016. The prior applications are incorporated herein by reference in their entirety.

FIELD

The present invention relates generally to aspirating face seals between rotor and stator assemblies and, more particularly, to an aspirating face seal having seal teeth.

BACKGROUND

Aspirating face seals are used to minimize leakage through a gap between two components and from a higher pressure area to a lower pressure area. Such seals have been disclosed for use in rotating machinery, including, but not limited to, turbomachinery such as gas turbine engines used for power generation and for aircraft and marine propulsion. Aspirating face seals are designed to minimize leakage of a fluid such as compressed air or combustion gases between a rotor and a stator in gas turbine engines. Aspirating face seals may facilitate compensating for transient variations that may exist in gaps between components. Aspirating face seals control fluid leakage in the engine by restricting fluid flow from areas of higher pressure to areas of lower pressure and be positioned between an engine stationary member and a rotating member within the engine.

Fluid leakage through gas turbine engine seal assemblies may significantly increase fuel consumption and adversely affect engine efficiency. Additionally, fluid leakage may cause damage to other components and/or increase overall engine maintenance costs. Because of the location of the seal assemblies and/or the operating environment, at least some known seal assemblies may deteriorate over time.

Some embodiments of aspirating face seals have the rotor configured as oppositely facing first and second seal elements often referred to as annular teeth with the first seal element either being attached to, or being a monolithic portion of, the rotor. Likewise, such seals typically have the stator configured as the second seal element with the second seal element either being attached to, or being a monolithic portion of, the stator.

U.S. Pat. No. 6,676,369 to Brauer, et al., issued Jan. 13, 2004, and entitled "Aspirating Face Seal with Axially Extending Seal Teeth" discloses a gas turbine engine aspirating face seal including a rotatable engine member and a non-rotatable engine member and a leakage path therebetween. Annular generally planar rotatable and non-rotatable gas bearing face surfaces circumscribed about a centerline are operably associated to the rotatable and non-rotatable engine members respectively. Radially inner and outer tooth rings axially extend away from a first one of the rotatable and non-rotatable gas bearing face surfaces across the leakage path and towards a second one of the gas bearing face surfaces. An auxiliary seal includes an annular restrictor tooth extending radially across the leakage path from a second one of the rotatable and non-rotatable gas bearing face surfaces towards the first one of the rotatable and non-rotatable gas bearing face surfaces. A pull-off biasing means is used for urging the inner and outer tooth rings axially away from the second one of the gas bearing face surfaces.

Known seal designs have also included an aspirator tooth extending from the stator axially across, and radially inward of, the air dam with the aspirator tooth having a tip spaced apart from and proximate the rotor. It is also important to note that aspirating face seal technology uses phrases such as "air bearing", "air dam", and "air flow", wherein it is understood that the word "air" is used to describe the working fluid of the seal. The working fluid of an aspirating face seal can include, without limitation, compressed air, combustion gases, and/or steam. Note, that an aspirating face seal is a non-contacting seal in that the first and second parts of the seal are not supposed to touch but often do for short periods of time during which they experience what are known as rubs.

When the primary tooth is on the rotor, the air jet from the primary tooth forms an air curtain and reduces the venting effectiveness of a plurality of circumferentially spaced apart vent passages or inclined holes through the face seal ring which provide pressure communication between high and low pressure regions of the seal. Engine transients may lead to coning of the seal which cone flat annular seal faces. It is desirable that aspirating face seals be able to better control deflections of the force generation areas and air pressure on different portions of the seal which affect force balance. It is desirable that aspirating face seals be able to prevent or reduce fouling the seal with contamination (example oil when seal is located near sump). Oil fouling can occur during engine operation or even after the engine is off because some sump seals are less effective without the pressure from an operating engine.

SUMMARY

A turbomachine aspirating face seal assembly includes an aspirating face seal operable for restricting leakage of high pressure air from a relatively high pressure region of the turbomachine to a relatively low pressure region of the turbomachine at a juncture between a non-rotatable member of the turbomachine and a rotatable member of the turbomachine. The rotatable and non-rotatable members include gas bearing rotatable and non-rotatable face surfaces respectively and primary, starter, and deflector seal teeth mounted on a seal teeth carrier on the rotatable member.

The primary and starter seal teeth may be annular labyrinth seal teeth designed and operable to sealingly engage corresponding abradable primary and starter seal lands respectively on the non-rotatable member. An annular slider is axially slidingly mounted on the non-rotatable member and incudes the primary and starter seal lands, the non-rotatable face surface mounted on the slider, and a pull-off biasing means for urging the annular slider away from the rotatable member. The pull-off biasing means also is for urging and the non-rotatable face surface away from the rotatable surface and the primary and starter seal lands away from the primary and starter seal teeth respectively.

The seal may include a secondary seal in sealing engagement with an annular radially inner slider surface of the annular slider in the low pressure region and the pull-off biasing means located radially outwardly of the annular slider in the high pressure region.

The pull-off biasing means may include a plurality of circumferentially spaced apart coil springs disposed within spring chambers of circumferentially spaced apart cartridges, annular housings surrounding the spring chambers and attached to the annular non-rotatable member, and forward ends of the coil springs resting against axially forward static stop fingers extending radially outwardly from and attached to or part of the annular slider. Tongues may extend radially inwardly from the housings into grooves in the annular slider. The cartridges may be attached to an annular flange around and fixed to the annular non-rotatable member. The seal may further include pairs of lugs extending radially outwardly from the annular flange, lug bolt holes disposed through the lugs, ear bolt holes through ears attached to the cartridges, and bolts disposed through the ear bolt holes and through the lug bolt holes.

The annular slider may include a central ring and annular forward and aft extensions extending forwardly and aftwardly respectively from the central ring, the biasing means positioned radially outwardly of the forward extension and the secondary seal positioned radially inwardly of the forward extension. The primary seal land carried on the annular extension, the non-rotatable face surface mounted on a radially inner aftwardly extending annular ledge of the central ring, first and second pluralities of circumferentially spaced apart first and second vent passages respectively extending through the central ring, the second vent passages extending substantially radially inwardly through the annular ledge, and the deflector seal tooth oriented to direct primary seal airflow from a gas bearing space extending axially between the non-rotatable and rotatable face surfaces.

Air feed passages may extend radially inwardly from the high pressure region through the central ring and through the non-rotatable face surface to the gas bearing space.

A drain assembly may be provided for preventing oil from flowing into the aspirating face seal and may include a drain hole in the non-rotatable member located upstream or forward of the aspirating face seal and the secondary seal, a radially inwardly sloping inner surface of the non-rotatable member, and the radially inwardly sloping inner surface extending at least between the drain hole and the aspirating face seal and tapering radially inwardly between the drain hole and the aspirating face seal. An annular oil dam may depend from an aft or downstream end of the non-rotatable member and located upstream or forward of the aspirating face seal. The non-rotatable member may be coupled to an annular frame and a bearing supported by the frame may be in an annular sump bounded by a sump member located radially inwardly of the non-rotatable member.

DETAILED DESCRIPTION

Figure 1:
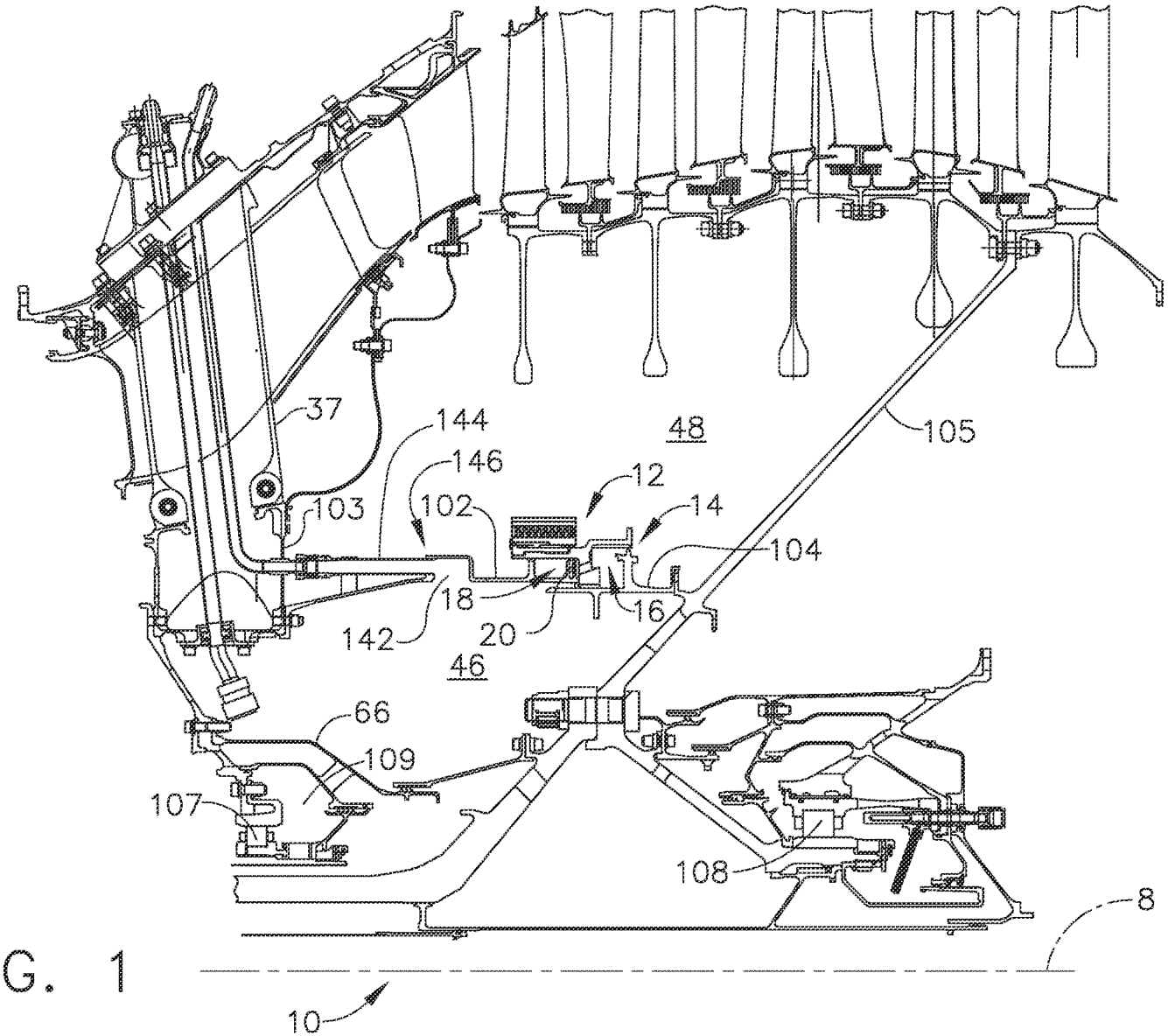
FIG. 1 is a cross-sectional view illustration of a portion of an exemplary gas turbine engine with a first exemplary embodiment of an aspirating gas bearing face seal with primary, starter, and deflector seal teeth mounted on a rotor of the engine.
Figure 2:
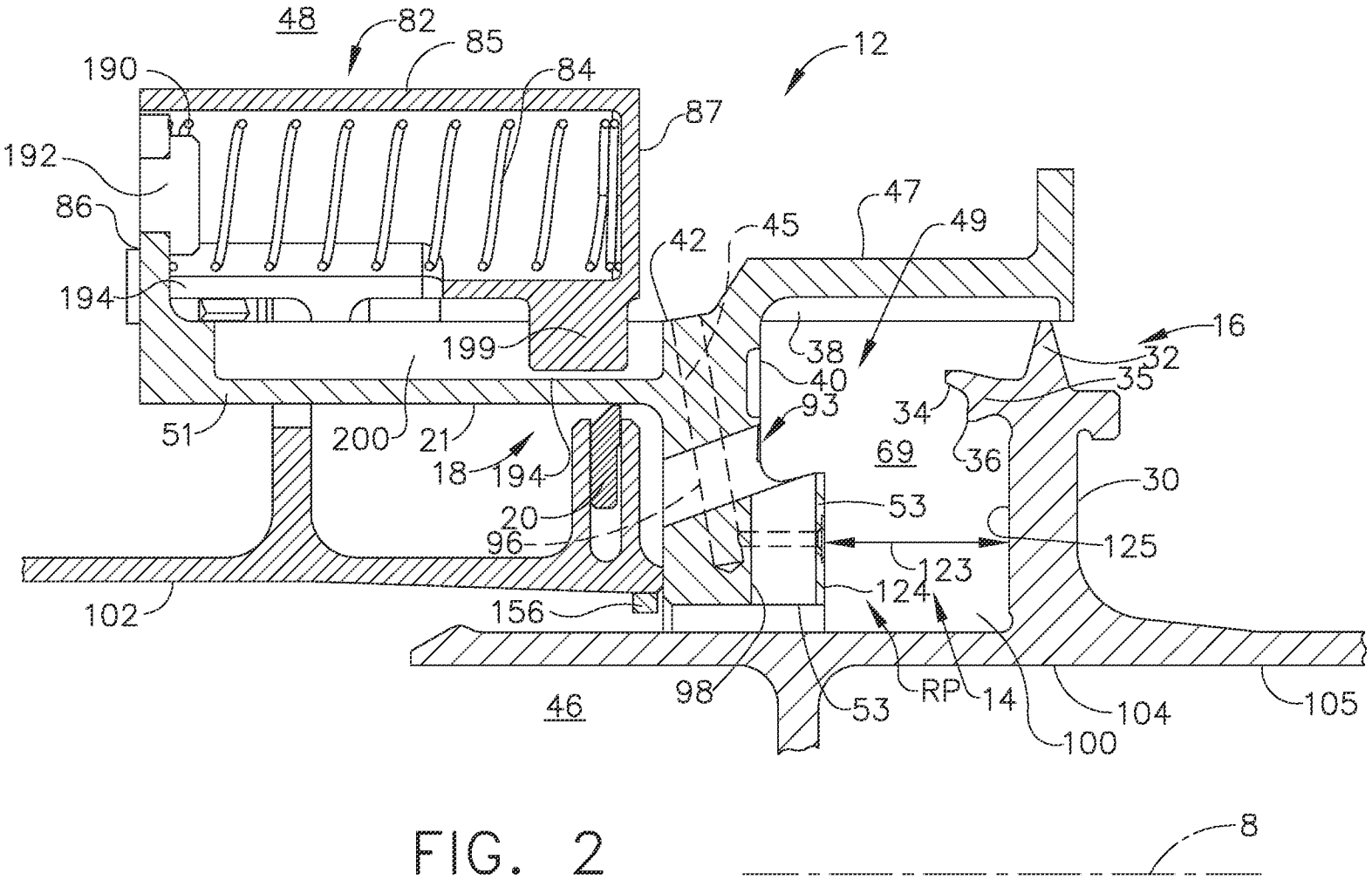
FIG. 2 is an enlarged cross-sectional view illustration of the aspirating gas bearing face seal illustrated in FIG. 1 in an opened engine off position.
Figure 3:
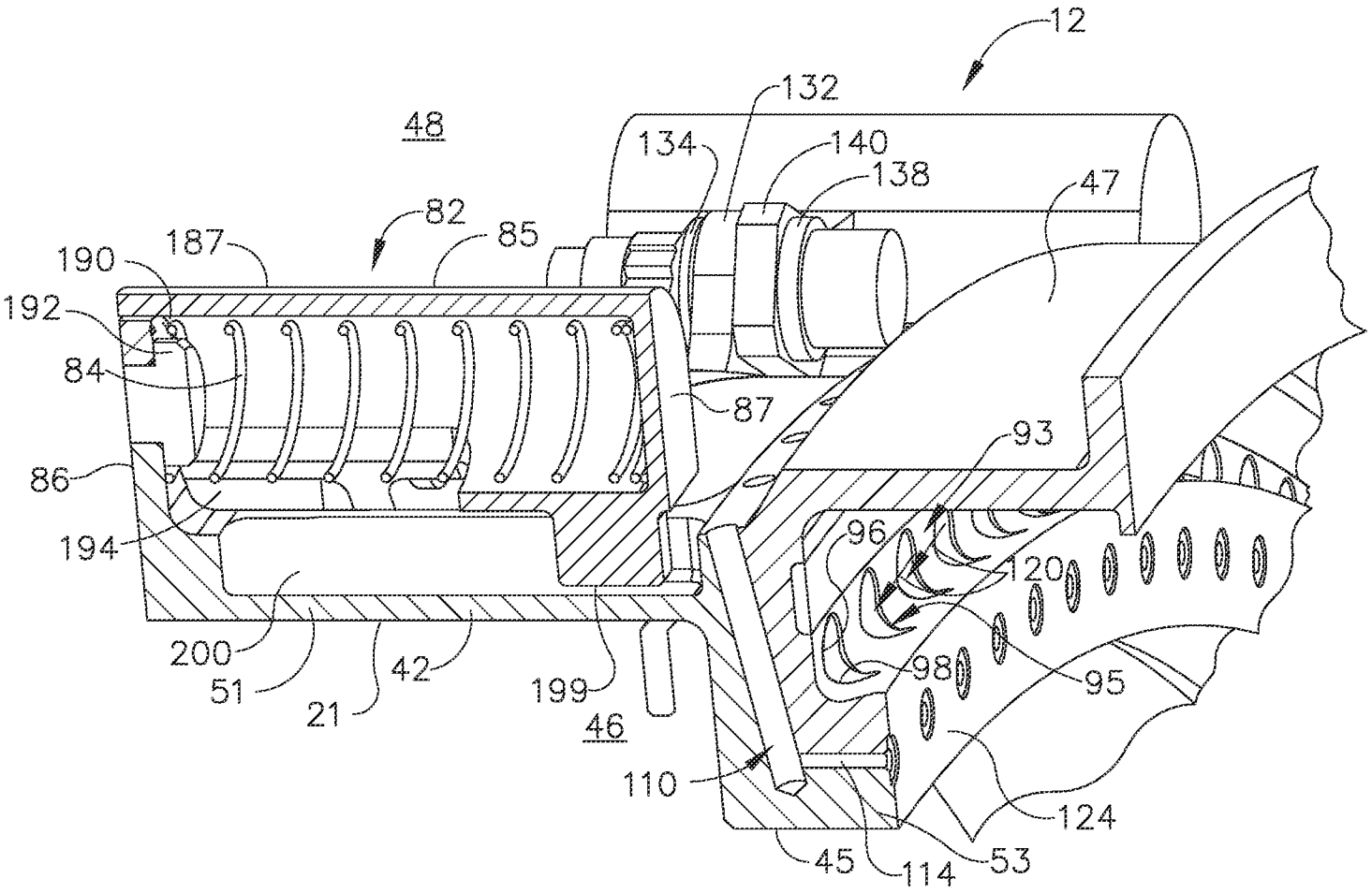
FIG. 3 is a cut-away perspective view illustration of a stator portion of the aspirating gas bearing face seal illustrated in FIG. 2.

Illustrated in FIGS. 1-3 is a first exemplary embodiment of an aspirating face seal assembly 12 having a primary seal 14 which is an annular aspirating face seal 16 and a secondary seal 18 which is illustrated herein as including a piston ring 20. The seal assembly 12 is designed for controlling leakage or sealing between a high pressure region 48 and a low pressure region 46 such as may be found in a turbomachine such as a gas turbine engine 10. Turbomachines include but are not limited to steam turbines, compressors and turbocompressors such as may be used in the gas and oil industry, or similar apparatus.

In the exemplary embodiment, turbomachine or gas turbine engine 10 is circumscribed about a centerline axis 8 of the engine 10 and includes an annular stationary stator or non-rotatable member 102 coupled to an annular frame 103 and a rotating or rotatable member 104 at least in part rotatably supported by an aft bearing 108. The frame 103 is illustrated herein as an annular turbine center frame 37 circumscribed about the centerline axis 8 of the engine 10. Additionally, non-rotatable member 102 is a stationary annular member circumscribed about the centerline axis 8 of the gas turbine engine 10. In the embodiments illustrated herein, non-rotatable member 102 is bolted to the frame 103 and the rotatable member 104 is part of a rotor 105 that is rotatably coupled within engine 10 to rotate about the centerline axis 8. The high pressure region 48 is located radially outwardly of the low pressure region 46 and the non-rotatable member 102 is located radially between the high and low pressure regions 48, 46. The frame 103 supports a middle bearing 107 in an annular sump 109 bounded by a generally conical sump member 66 located radially inwardly of the non-rotatable member 102.

A drain hole 142 in the non-rotatable member 102 is located upstream or forward of the aspirating face seal 16 and the secondary seal 18. A drain tube 144 is connected to and in fluid communication with drain hole 142. The drain tube 144 and the drain hole 142 provides a drain assembly 146 to help prevent oil from flowing into the aspirating face seal 16.

Figure 12:
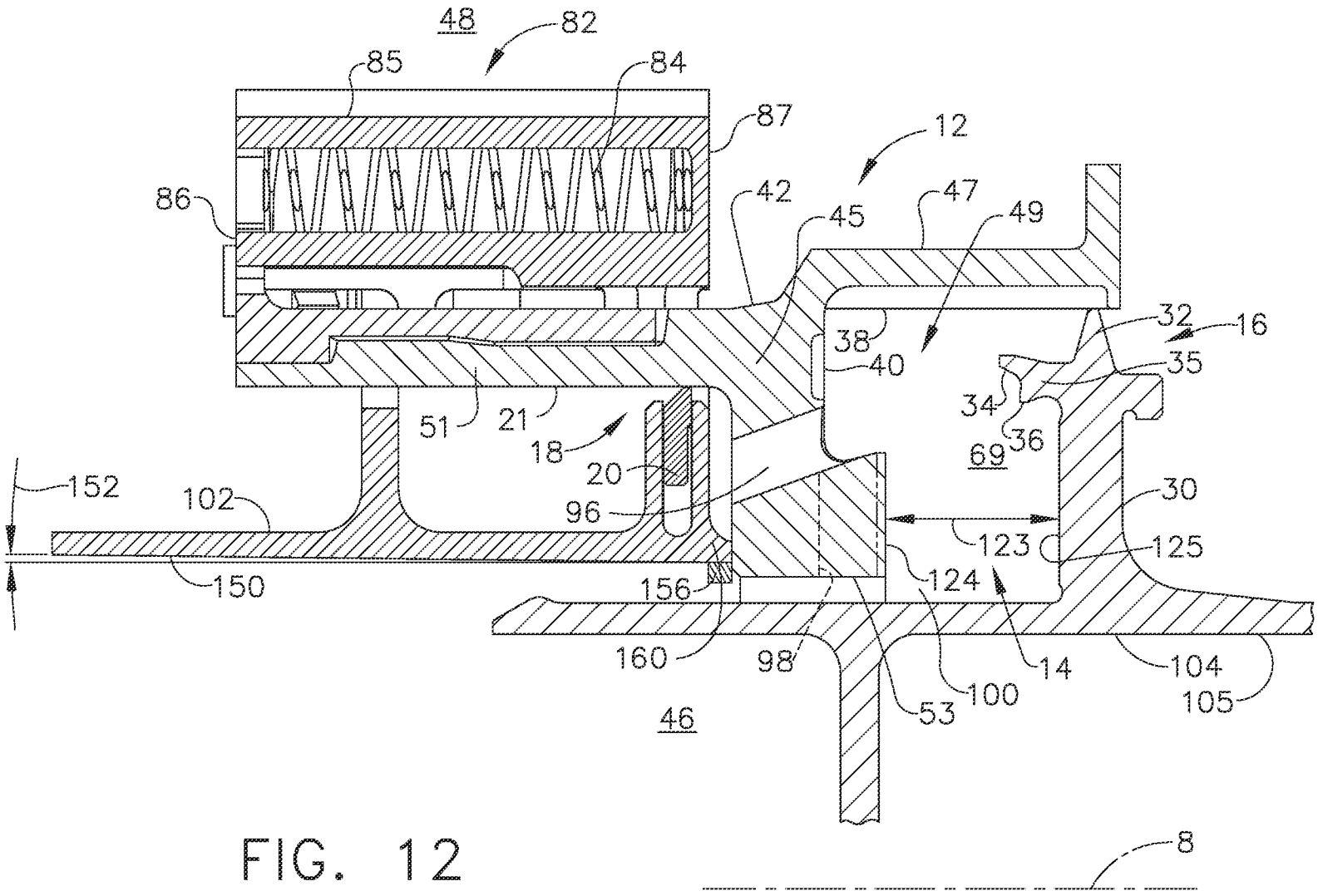
FIG. 12 is a cross-sectional view illustration of an alternative embodiment of the aspirating gas bearing face seal illustrated in FIG. 2 with an oil dam on the stator.

FIG. 12 illustrates another feature designed to help prevent oil from flowing into the aspirating face seal 16. A radially inwardly sloping inner surface 150 of the non-rotatable member 102 extends forwardly and opens radially outwardly at least from the aspirating face seal 16 to the drain hole 142. The radially inwardly sloping inner surface 150 extending at least between the drain hole 142 and the aspirating face seal 16 tapers radially inwardly between the drain hole 142 and the aspirating face seal 16. The sloping inner surface 150 may be conical and taper radially inwardly from the drain hole 142 to the aspirating face seal 16. This provides the inner surface 150 with a constant negative slope 152 with respect to the centerline axis 8. The slope 152 may be small such as about negative two degrees to minimize impact on the design of the stator. An annular oil dam 156 may depend from an aft or downstream end 160 of the non-rotatable member 102 and be located forward or upstream of the aspirating face seal 16. The oil dam 156 is spaced radially apart from the rotatable member 104 and helps prevent oil from being ingested into the aspirating face seal 16.

Referring to FIGS. 1-3, the aspirating face seal 16 is used to restrict leakage of high pressure air 120 from the relatively high pressure region 48 to a relatively low pressure region 46 at the juncture 49 between the non-rotatable member 102 and the rotatable member 104. The aspirating face seal 16 includes a leakage path 41 between the rotatable and non-rotatable members 104, 102 and between gas bearing rotatable and non-rotatable face surfaces 125, 124 respectively. The rotatable and non-rotatable face surfaces 125, 124 are circumscribed around and generally perpendicular to the engine centerline axis 8. Non-contact sealing during engine operation is obtained with the help of an air bearing film formed between the rotatable and non-rotatable face surfaces 125, 124 which function as a slider bearing face and a rotor bearing face respectively.

The embodiment of the aspirating face seal 16 illustrated in FIGS. 2 and 3 includes a rotatable seal teeth carrier 30 in the form of a flange on the rotatable member 104 of the rotor 105. The rotatable face surface 125 is on the carrier 30. Primary, starter, and deflector seal teeth 34, 32, 36 are mounted radially outwardly of the rotatable face surface 125 on the seal teeth carrier 30. The primary and starter seal teeth 34, 32 are annular labyrinth seal teeth designed and operable to sealingly engage corresponding abradable primary and starter seal lands 40, 38 located and mounted on an annular slider 42 axially slidingly mounted on the annular non-rotatable member 102 illustrated in FIGS. 2 and 3. The annular slider 42 includes a central ring 45 and annular forward and aft extensions 51, 47 extending forwardly and aftwardly respectively from the central ring 45.

The primary seal land 40 faces radially inwardly from and is carried on the annular aft extension 47. The starter seal land 38 faces axially aftwardly from and is carried on the central ring 45 of the annular slider 42. The starter seal land 38 is recessed forwardly of the non-rotatable face surface 124 on the central ring 45. The non-rotatable face surface 124 is mounted on a radially inner aftwardly extending annular ledge 53 of the central ring 45.

The primary seal tooth 34 extends axially aft and slightly radially inwardly from a forward carrier extension 35 of the seal teeth carrier 30. The deflector seal tooth 36 extends axially aft and slightly radially outwardly from the forward carrier extension 35 of the seal teeth carrier 30. The forward carrier extension 35 extends forwardly from the seal teeth carrier 30 and supports the primary and the deflector seal teeth 34, 36. The starter seal tooth 32 extends substantially radially from the teeth carrier 30 and substantially normal to the centerline axis 8 of the engine 10. The abradable primary and starter seal lands 40, 38 may be made of or include an abradable material. The abradable material may be a honeycomb material, thermal spray abradable material such as nickel graphite, or other abradable material.

The non-rotatable face surface 124 is located radially inwardly of the primary and starter seal lands 40, 38 on the annular slider 42 and is substantially parallel to the rotatable face surface 125 on the rotatable member 104. The non-rotatable and rotatable face surfaces 124, 125 are axially spaced apart a variable distance 123 and cooperate to axially move the slider 42 axially under a pressure differential between the high and low pressure regions 48, 46. A variable axial length annular plenum 69 extends axially between the slider 42 and the rotatable face surface 125. A gas bearing space 100 extends axially between the non-rotatable and rotatable face surfaces 124, 125.

Figure 4:
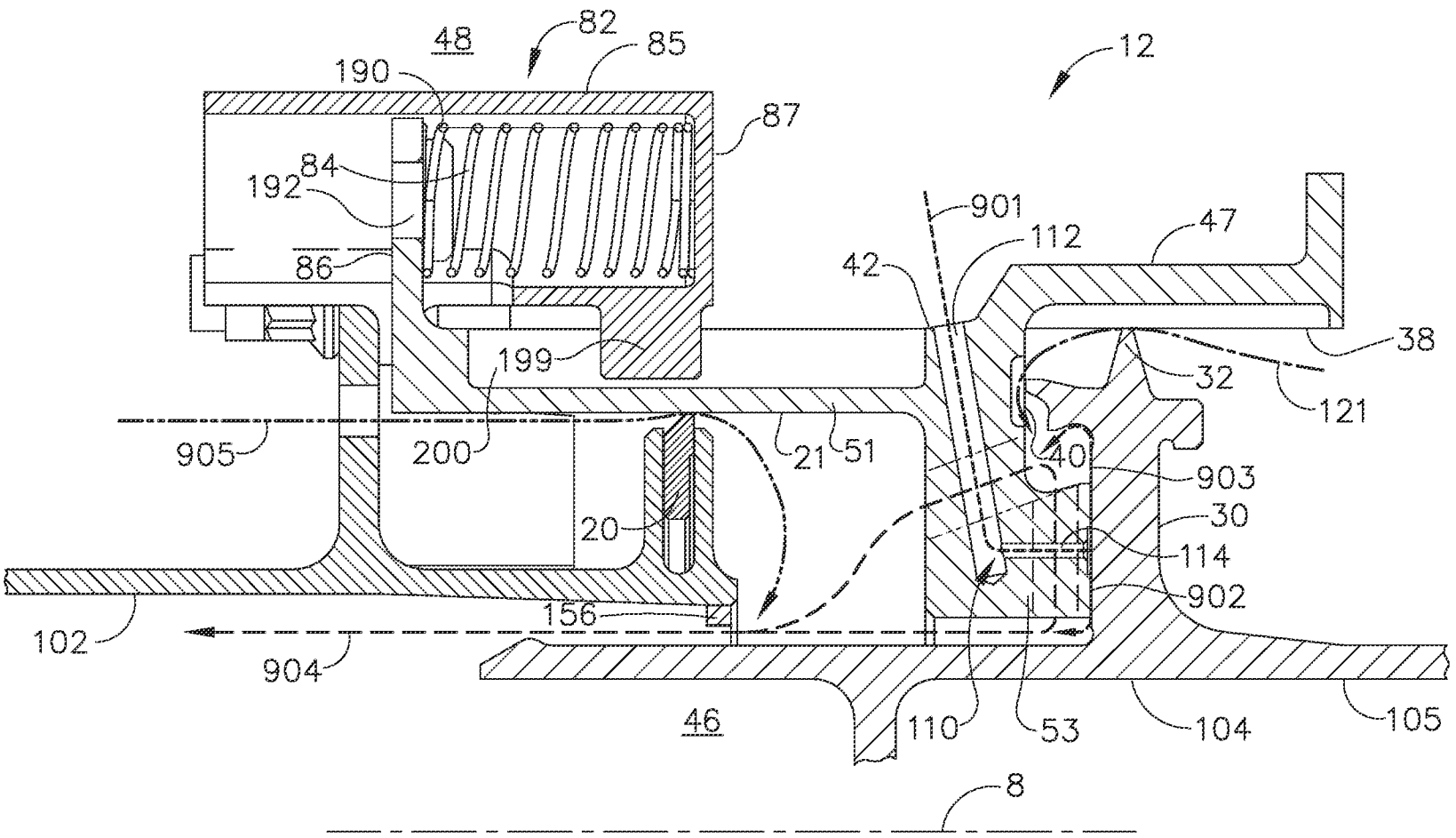
FIG. 4 is a cross-sectional view illustration of the aspirating gas bearing face seal illustrated in FIG. 2 with feed holes extending radially inwardly through an aft ring of the stator of the aspirating gas bearing face seal in a closed position.
Figure 5:
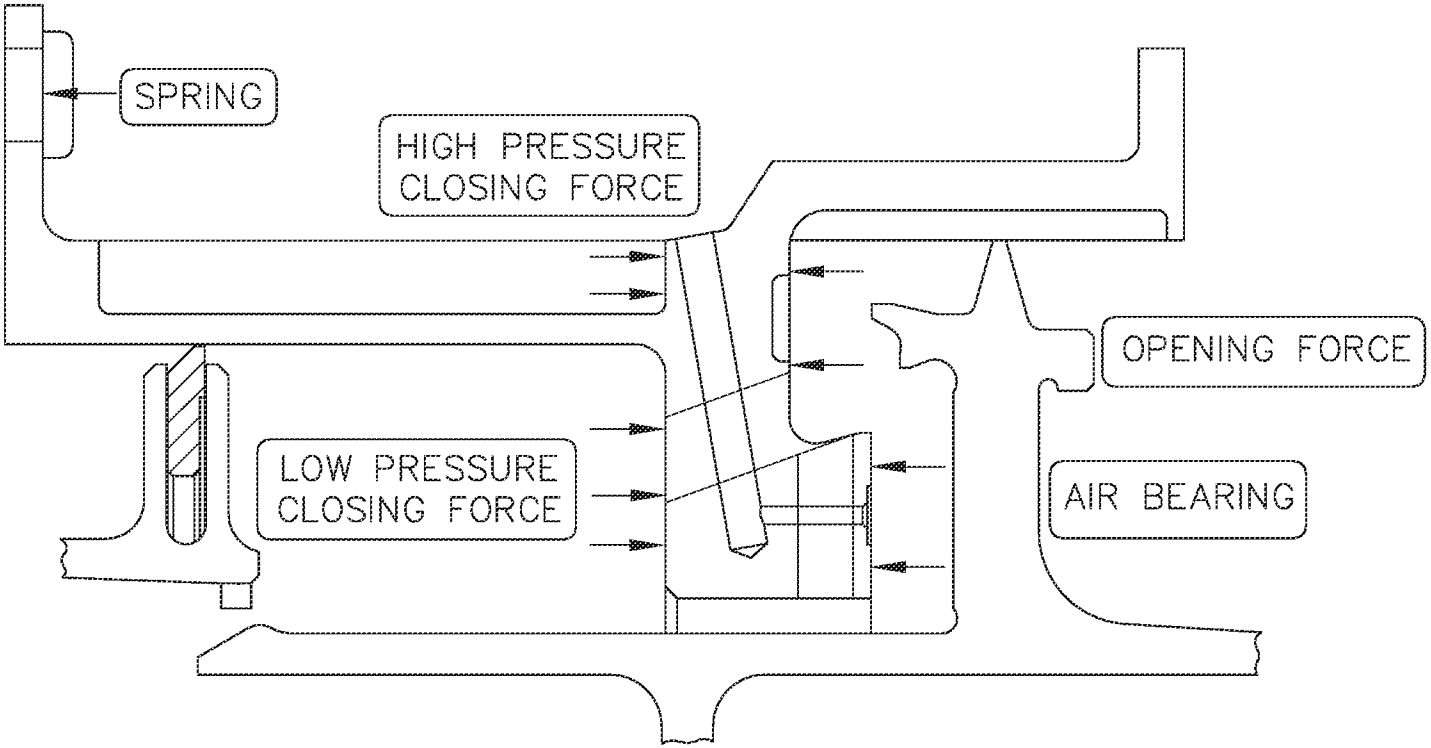
FIG. 5 is a diagrammatical illustration of forces acting on the aspirating gas bearing face seal illustrated in FIG. 4.
Figure 6:
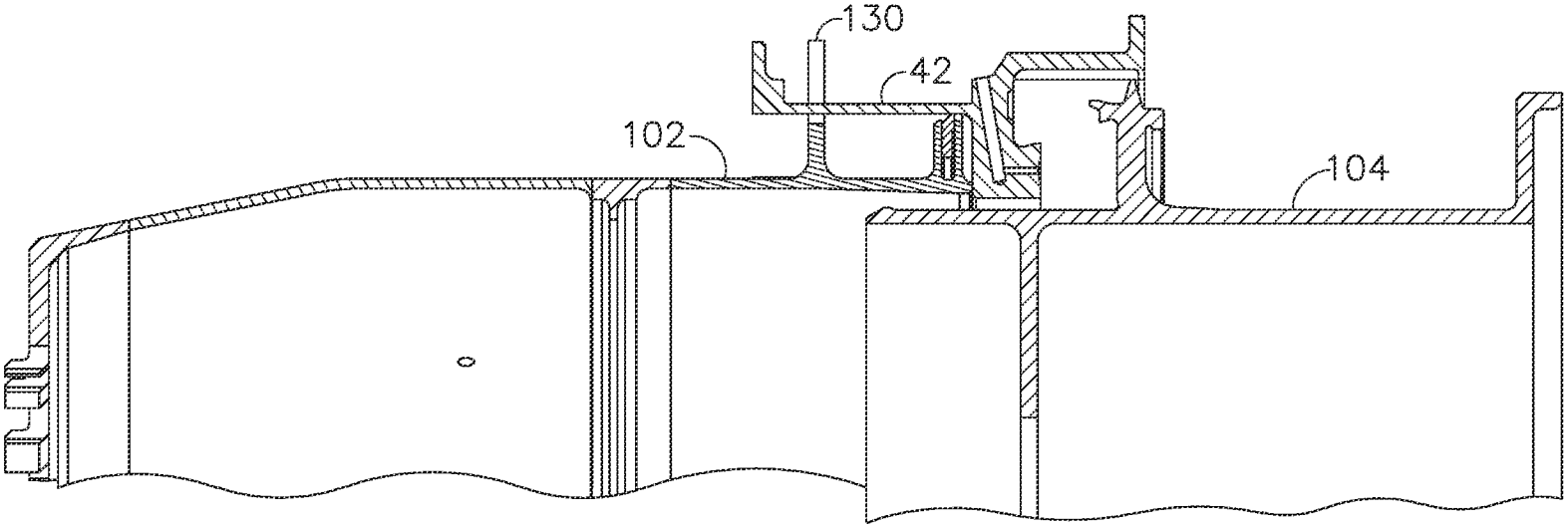
FIG. 6 is a cross-sectional view illustration of a slider and the aspirating gas bearing face seal illustrated in FIG. 4.
Figure 7:
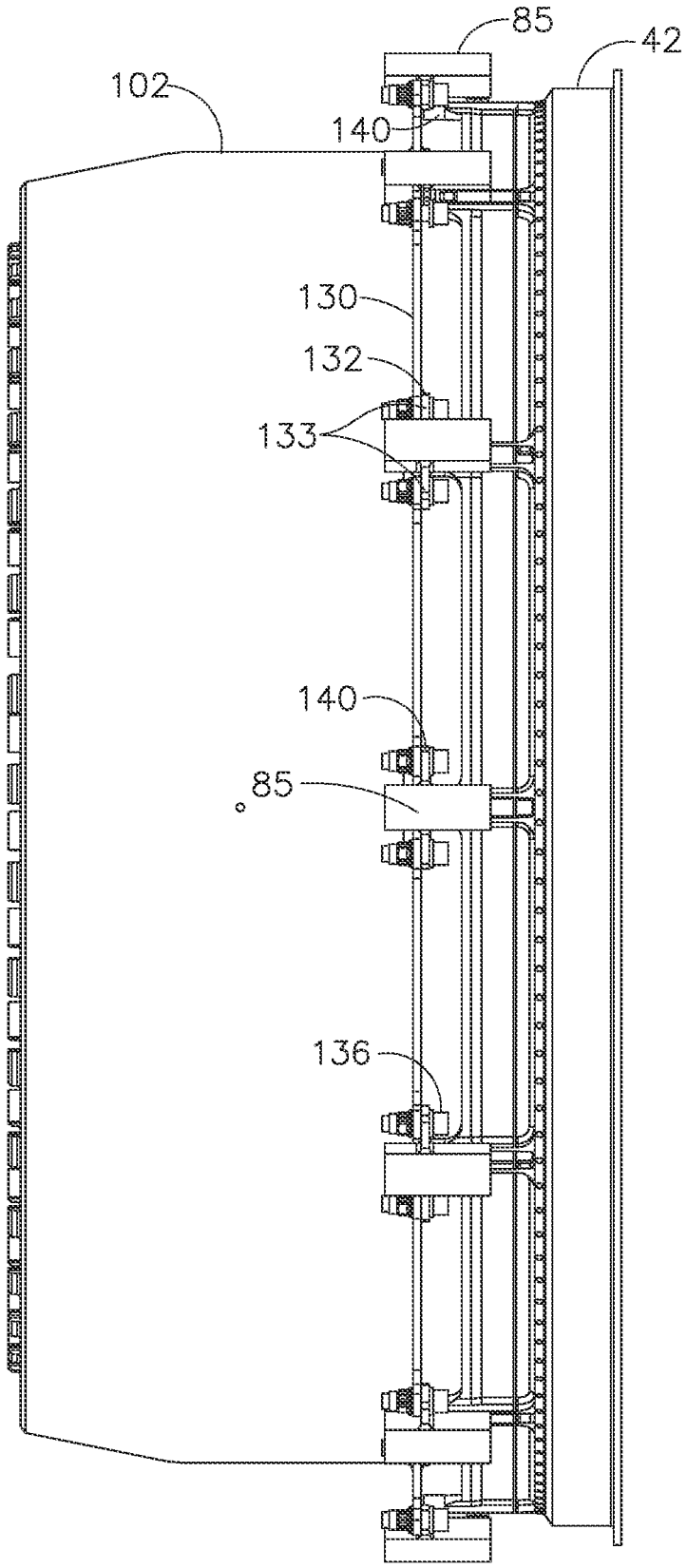
FIG. 7 is a radially inwardly looking perspective view illustration of the slider illustrated in FIG. 6.
Figure 8:
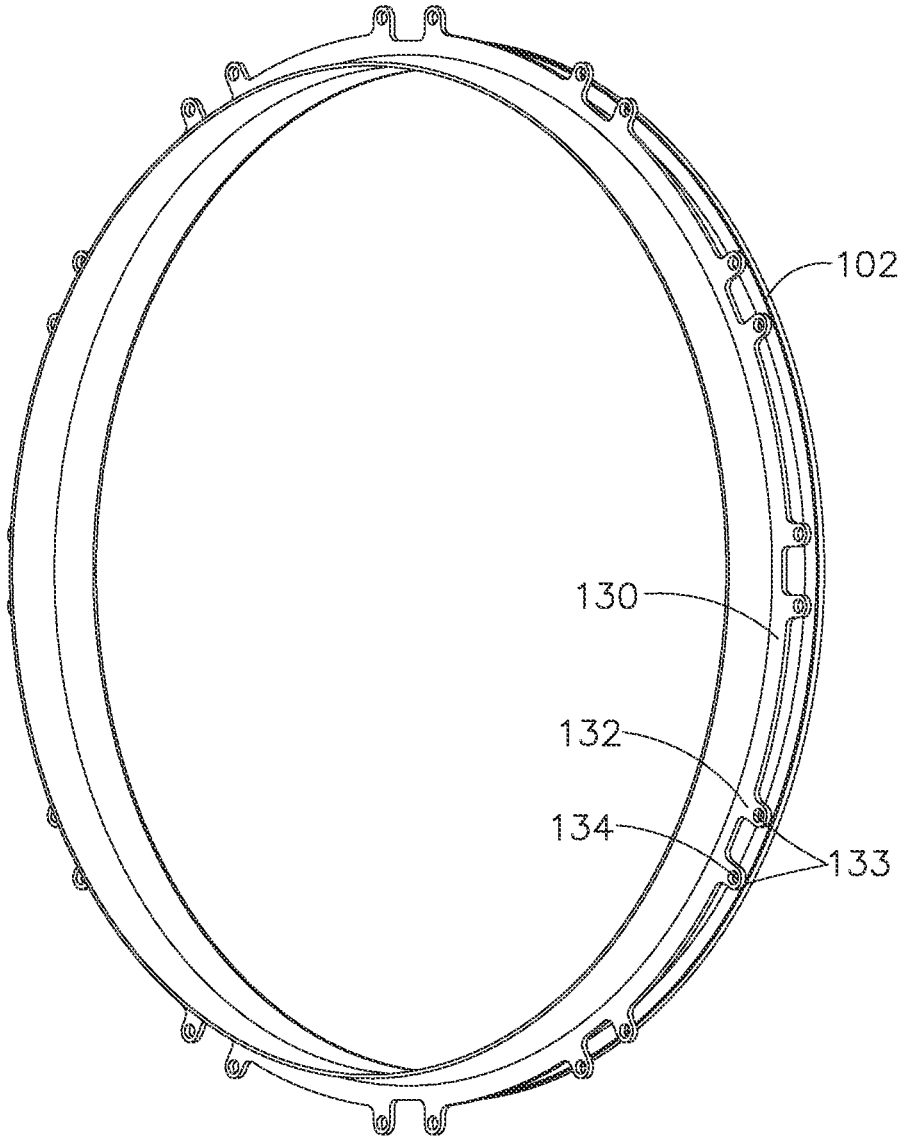
FIG. 8 is perspective view illustration of an annular flange around and fixed to the stator illustrated in FIG. 3.
Figure 9:
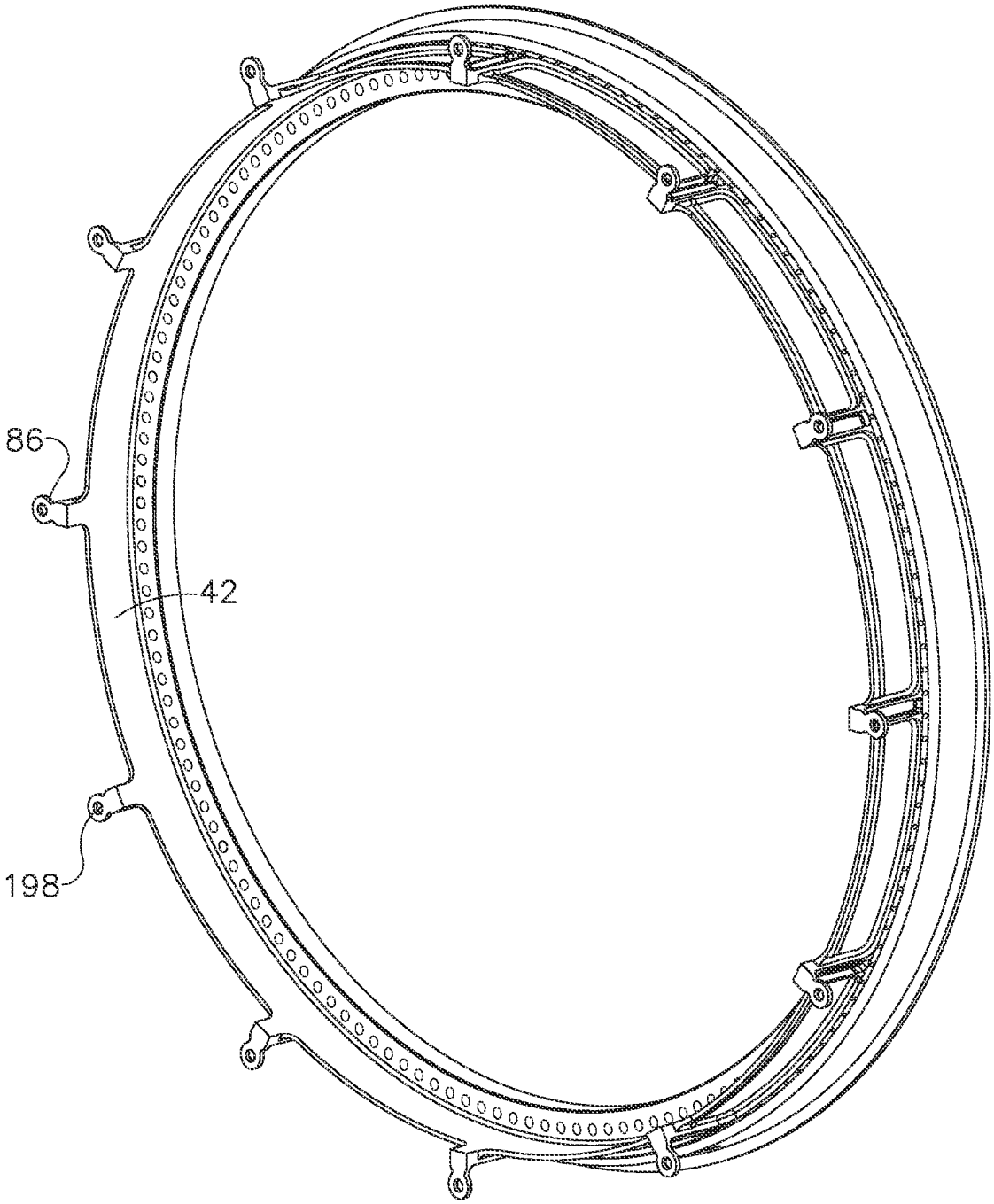
FIG. 9 is perspective view illustration of the slider illustrated in FIG. 3.
Figure 10:
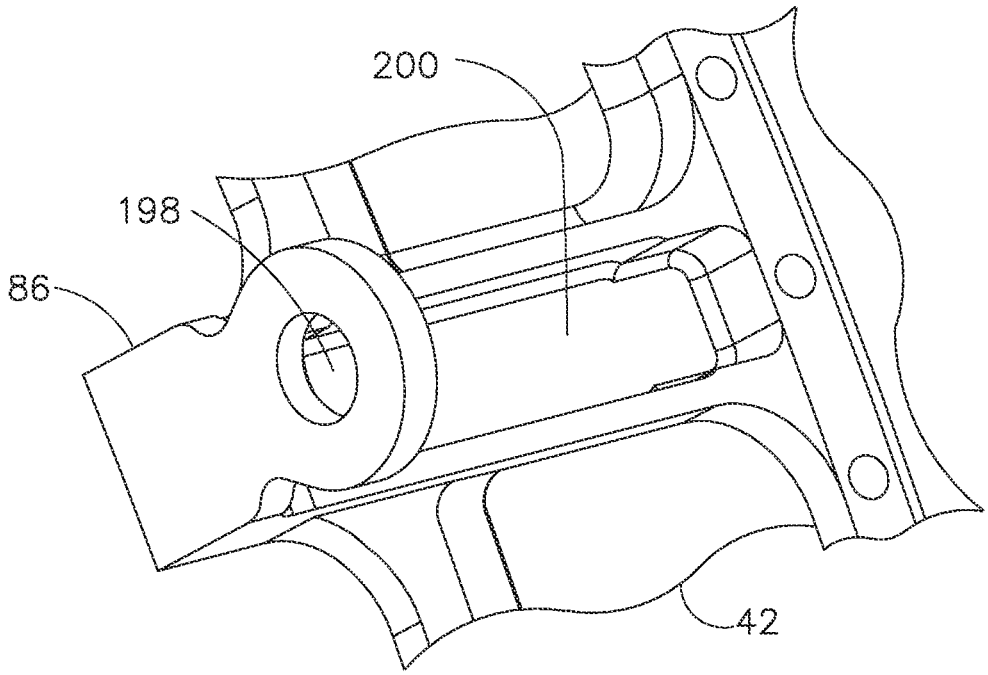
FIG. 10 is perspective view illustration of a groove in the slider for receiving a tongue extending inwardly from a housing of a spring cartridge illustrated in FIG. 3.
Figure 11:
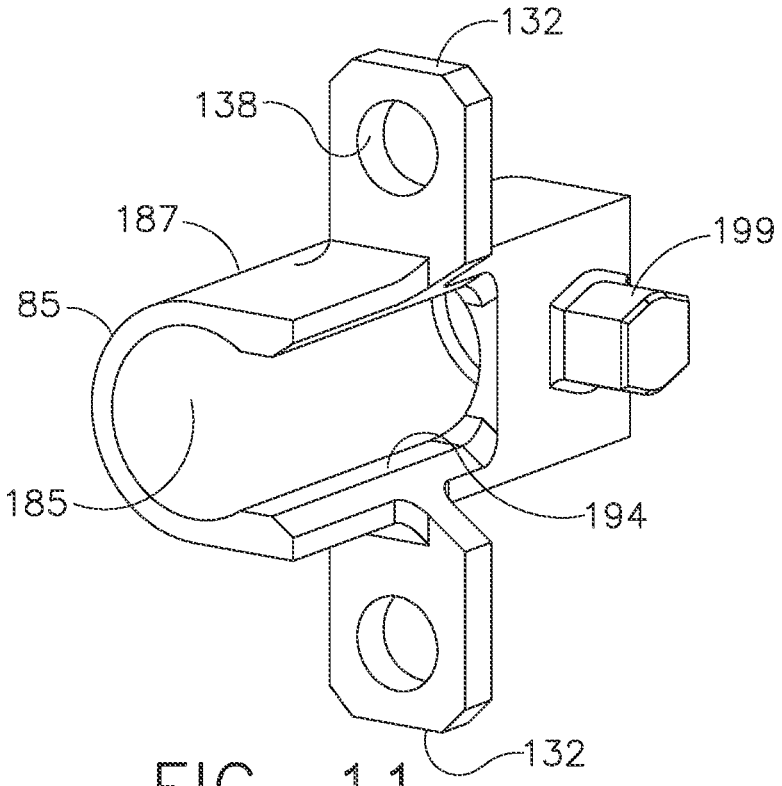
FIG. 11 is perspective view illustration of the housing of the spring cartridge mounted to the flange illustrated in FIG. 3.

Referring to FIGS. 3-5, air feed passages 110 extend through the central ring 45 of the annular slider 42 and from the high pressure region 48 to the gas bearing space 100 between the non-rotatable and rotatable face surfaces 124, 125. The exemplary embodiment of the feed passages 110 illustrated herein includes feed holes 112 extending generally radially inwardly from the high pressure region 48 through the central ring 45 to corresponding axially extending orifice bores 114 in the central ring 45. The orifice bores 114 extend axially through the central ring 45 from the feed holes 112 through the non-rotatable face surface 124 to the gas bearing space 100.

First and second pluralities 93, 95 of circumferentially spaced apart first and second vent passages 96, 98 through the central ring 45 of the annular slider 42 provide pressure communication between the plenum 69 and low pressure region 46. The first and second vent passages 96, 98 vent the plenum 69 with low pressure air from the low pressure region 46 during engine operation when there is a substantial pressure differential between high and low pressure regions 48, 46. The first vent passages 96 are inclined radially inwardly and extend from the plenum 69 forward and radially inwardly. The second vent passages 98 extend substantially radially inwardly from the plenum 69 through the annular ledge 53 of the central ring 45 of the annular slider 42.

The starter seal tooth 32 is used to initiate closure of the aspirating face seal 16. During failure modes, a starter tooth/land gap may close significantly. Failure modes may include large pressure imbalance between the high and low pressure regions 48, 46, large radial relative displacements between rotating and stationary components would be caused by a large imbalance of the rotating assembly. The starter tooth 32 is located on the seal teeth carrier 30 mounted to the rotor 105 and extends radially towards the non-rotatable abradable starter seal land 38. This design allows the starter tooth to rub into an abradable during high radial excursions rather than have metal to metal contact. The deflector seal tooth 36 is used to help reduce build-up of interior pressures in the gas bearing space 100 and the annular plenum 69 between the stationary and rotating seal surfaces.

Figure 4A:
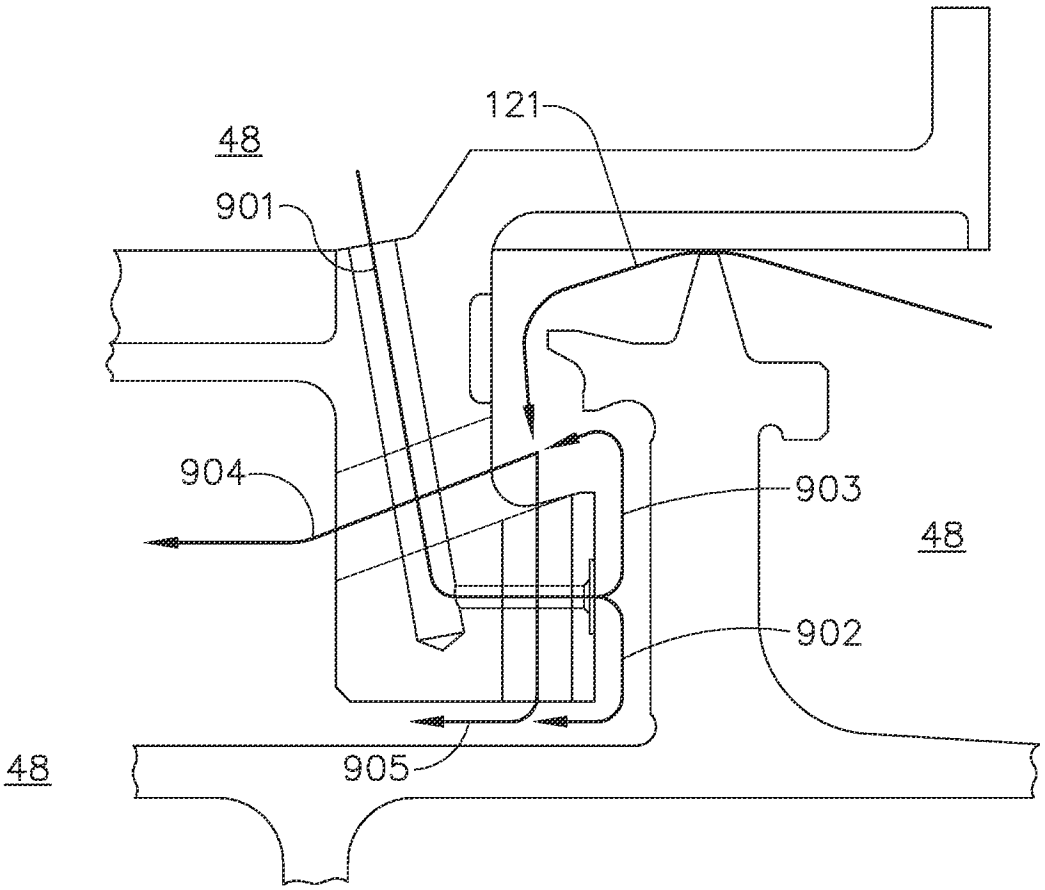
FIG. 4A is a cross-sectional view illustration of flows through the aspirating gas bearing face seal illustrated in FIG. 4 in a partially open position.

FIG. 4A illustrates various air flows through the aspirating face seal 16 during engine operation when the aspirating face seal 16 is partially open. Gaps between the primary and starter seal teeth 34, 32 and the primary and starter seal lands 40, 38 respectively allow room to draw flows between the teeth and lands. Bearing flow 901 comes from the high pressure region 48 through the air feed passages 110 into the gas bearing space 100 between the non-rotatable and rotatable face surfaces 124, 125. The bearing flow 901 exits the gas bearing space 100 as radially outward bearing flow 903 and radially inward bearing flow 902. The radially outward bearing flow 903 passes through the first and second vent passages 96, 98 and together with the radially inward bearing flow 902 passes through a gap between the rotatable member 104 of the rotor 105 and the non-rotatable member 102 to reach the low pressure region 46.

Primary seal flow 121 leaks or flows between the primary seal tooth 34 and the primary seal land 40 and then between the starter seal tooth 32 and the starter seal land 38. During engine operating conditions with the aspirating face seal 16 closed the primary seal tooth 34 is the main restriction to air flow through the aspirating face seal 16. The primary seal leakage or primary seal flow 121 merges with the bearing flow 901 in the annular plenum 69 and the merged flows exit the aspirating face seal 16 as axial and radially inward vent flows 904, 905 passing through the first and second vent passages 96, 98 respectively. The merged flows then passes through the gap between the rotatable member 104 of the rotor 105 and the non-rotatable member 102 to reach the low pressure region 46.

The primary seal flow 121 across the primary seal tooth 34 and radially outward bearing flow 903 enter the plenum 69 as jets due to a pressure drop across the aspirating face seal 16 from the high pressure region 48 to the low pressure region 46. The primary seal flow 121 exits the gap between the primary seal tooth 34 and the primary seal land 40 traveling substantially radially inward towards the first and second vent passages 96, 98. The radially outward bearing flow 903 enters the plenum 69 traveling radially outwardly and is redirected by deflector tooth 36 towards the first and second vent passages 96 and 98. The radially outward bearing flow 903 and the primary seal flow 121 merge into the axial and radially inward vent flows 904, 905 which flow out from plenum 69 through the first and second vent passages 96, 98 respectively to the low pressure region 46.

The redirection of radially outward bearing flow 903 by the deflector tooth 36 increases penetration into the first and second vent passages 96, 98 causing a higher discharge coefficient (Cd) and greater effective passage area. This causes the air pressure in plenum 69 to approach that of the low pressure region 46. Similarity in pressure between plenum 69 and the low pressure region creates a more stable force balance acting on slider 42 which results in a more determinate operating clearance between air bearing surfaces. Cd is a standard engineering ratio used to find the effective area of a hole or passage that a fluid is passing through, i.e actual area*Cd=effective area. A perfect Cd=1 but Cd for real holes are something lower than that.

The bearing airflow across the primary seal tooth 34 is a jet of air due to a pressure drop across the primary tooth and is directed away from the first and second vent passages 96, 98 in the slider 42. Pressure in the annular plenum 69 drops faster and the closing process will be more determinate. The deflector seal tooth 36 is located downstream and radially inwardly of the primary seal tooth 34 and radially outwardly of the non-rotatable face surface 124. The deflector seal tooth 36 directs the bearing airflow jet into the first and second vent passages 96, 98 at close clearances between the stationary and rotating seal surfaces, helps maintain the effectiveness of the aspirating face seal 16, and aids the exhaust of the vent flow 904 to create a more determinant pressure in plenum 69.

During higher power operation, the primary seal tooth 34 restricts the air 120 flowing from the relatively high pressure region 48 to the relatively low pressure region 46, thereby, causing an increase in the pressure differential between high and low pressure regions 48, 46. A high pressure differential between high and low pressure regions 48, 46 acts on areas of the slider 42 upstream of the starter tooth 32 resulting in a net axial force that urges slider 42 and the primary and starter seal lands 40, 38 located on the slider 42 toward the rotatable face surface 125 on the rotatable member 104 and the primary, starter, and deflector seal teeth 34, 32, 36. The aspirating face seal 16 is illustrated in the open position in FIG. 4 and in the closed position in FIG. 5.

A pull-off biasing means 82 is used for urging the annular slider 42 and the non-rotatable face surface 124 and the starter seal land 38 thereon axially away from the rotating seal surface and the primary, starter, and deflector seal teeth 34, 32, 36 on the rotatable member 104 during low or no power conditions. During low or no power conditions, the slider 42 and the non-rotatable face surface 124 are biased away from the rotatable face surface 125 or the rotating seal surface on the rotatable member 104 by the biasing means 82. This causes the gas bearing space 100 and the annular plenum 69 to axially lengthen and the primary seal tooth 34 to retract from the primary seal land 40 on the slider 42.

Referring to FIGS. 3-11, the biasing means 82 is illustrated herein as a plurality of circumferentially spaced apart coil springs 84 disposed within spring chambers 185 of circumferentially spaced apart cartridges 85. Each of the cartridges 85 includes an annular housing 187 surrounding the spring chamber 185 attached to the annular non-rotatable member 102. An aft end wall 87 of the annular housing 187 may be attached to the annular non-rotatable member 102. A forward end 190 of the coil spring 84 rests against an axially forward static stop finger 86 which extends radially outwardly from and is attached to or part of the axially translatable annular slider 42 as further illustrated in FIG. 9. The stop finger 86 may be integrally formed with the axially translatable annular slider 42 as illustrated herein. A plug 192 disposed in an aperture 198 in the stop finger 86 extends into the chamber and anchors the coil spring 84 as illustrated in FIGS. 3-5.

The stop finger 86 extends radially through an axially extending slot 194 in the annular housing 187 into the spring chamber 185 as illustrated in FIGS. 3-4 and 10-11. This allows the slider 42 to translate axially and allow the coil spring 84 to compress and expand, thus, biasing the slider 42. A tongue 199 extends radially inwardly from the housing 187 into a groove 200 in the slider 42. This tongue and groove arrangement helps guide the axially translatable slider 42 during axial translation relative to the static housing 187 of the static cartridge 85. The slider 42 is thus capable of axial translation and limited gimballing motion in response to an axial force and tilt moments respectively.

Referring to FIGS. 3 and 6-11, the cartridge 85 is connected or attached to the annular non-rotatable member 102. The exemplary embodiment of the seal illustrated herein includes an annular flange 130 around and fixed to the annular non-rotatable member 102. The cartridges 85 are attached to the annular flange 130. The cartridges 85 may be attached to the annular flange 130 using pairs 133 of lugs 132 extending radially outwardly from the annular flange 130. The cartridges 85 may be bolted to the lugs 132 with bolts 136 disposed through ear bolt holes 138 through ears 140 attached to the cartridges 85 and through lug bolt holes 134 disposed through the lugs 132. Thus, the cartridges 85 may be removably mounted to the annular non-rotatable member 102. The annular flange 130 is illustrated herein as being continuous but may be segmented.

The biasing means 82 and the coil springs 84 are upstream, with respect to the bearing airflow in the gas bearing space 100, of the annular slider 42 and aspirating face seal 16 in the high pressure region 48. The biasing means 82 and the coil springs 84 are positioned upstream from the secondary seal 18 with respect to bearing airflow through the aspirating face seal 16. The biasing means 82 including the coil springs 84 and the secondary seal 18 are radially positioned on opposite sides of the forward extension 51. The forward extension 51 is radially disposed between the biasing means 82. The biasing means 82 including the coil springs 84 are positioned radially outwardly of the forward extension 51 and the secondary seal 18 is positioned radially inwardly of the forward extension 51. The secondary seal 18 is in sealing engagement with an annular radially inner slider surface 21 of the annular slider 42 and is located on a border between the high and low pressure regions 48, 46. The biasing means 82 and the coil springs 84 are located radially outwardly of the annular slider 42 and the secondary seal 18 is located radially inwardly of the annular slider 42. This helps to reduce pressure coning due to shape and/or length of the non-rotatable face surface 124 on the annular slider 42.

The central ring 45 of the annular slider 42 is designed to translate between axial retracted and sealing positions RP, SP illustrated in FIGS. 4 and 5 respectively as measured at the gas bearing non-rotatable face surface 124 as a result of forces, illustrated in FIG. 5, acting on the central ring 45. The central ring 45 is illustrated in its sealing position in FIG. 5. The forces are the result of pressures in the relatively low and high pressure regions 46, 48 acting on surfaces and spring forces of the biasing or biasing means 82.

As the engine is started, the compressor discharge pressure rises and the pressure in the high pressure region 48 begins to rise because the starter seal tooth 32 restricts the air 120 flowing from the relatively high pressure region 48 to the relatively low pressure region 46. The pressure differential between the low and high pressure regions 46, 48 results in a closing pressure force acting on central ring 45. The pressure force acts against a spring force from the biasing means 82 to urge the central ring 45 and non-rotatable face surface 124 mounted thereupon towards the gas bearing rotatable face surface 125. FIG. 5 illustrates high and low pressure closing forces acting on the aspirating face seal 16 during engine startup and how the closing forces overcomes the spring force. During shutdown of the engine, pressure in the low pressure region 46 drops off and the springs 84 of the biasing means 82 overcome the closing force and retract the aspirating face seal 16. Opening forces from high pressure air in the air bearing are also illustrated in FIG. 5.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

We claim:

1. A turbomachine aspirating face seal assembly comprising:

a rotatable member;

a non-rotatable member;

a seal teeth carrier mounted on the rotatable member, the seal teeth carrier comprising primary seal teeth that extend axially from the seal teeth carrier and starter seal teeth that extend radially from the seal teeth carrier;

an annular aft extension coupled to the non-rotatable member that comprises a starter seal land; and a radially-extending portion coupled to the non-rotatable member that comprises a primary seal land, wherein the aspirating face seal assembly is configured to restrict leakage of high pressure air from a relatively high pressure region of a turbomachine to a relatively low pressure region of the turbomachine at a juncture between the non-rotatable member of the turbomachine and the rotatable member of the turbomachine, and wherein the starter seal land faces radially inward.

2. The turbomachine aspirating face seal assembly of claim 1, wherein the primary seal land faces axially aftward.

3. The turbomachine aspirating face seal assembly of claim 1, wherein the annular aft extension and radially-extending portion are part of an annular slider that is axially slidingly mounted on the non-rotatable member, and wherein axial movement of the annular slider causes the aspirating face seal assembly to move between an open position and a closed position.

4. The turbomachine aspirating face seal assembly of claim 3, wherein the annular slider is biased away from a rotatable face surface of the seal teeth carrier with the aspirating face seal assembly in the open position.

5. The turbomachine aspirating face seal assembly of claim 4, wherein the annular slider and the rotatable face surface of the seal teeth carrier define an annular plenum with a variable axial length.

6. The aspirating face seal assembly of claim 4, further comprising a secondary seal in sealing engagement with an annular radially inner slider surface of the annular slider in the low pressure region, wherein the annular slider is biased away from the rotatable face surface by a pull-off biasing member that is located radially outwardly of the annular slider in the high pressure region.

7. The aspirating face seal assembly of claim 6, wherein the pull-off biasing member comprises a plurality of circumferentially spaced apart coil springs disposed within spring chambers of circumferentially spaced apart cartridges.

8. The aspirating face seal assembly of claim 7, wherein the circumferentially spaced apart cartridges are attached to one or more annular flanges mounted on the non-rotatable member.

9. The aspirating face seal assembly of claim 3, further comprising:

first and second pluralities of circumferentially spaced apart first and second vent passages respectively extending through the radially-extending portion of the annular slider.

10. The aspirating face seal assembly of claim 9, further comprising deflector seal teeth mounted on the seal teeth carrier and oriented to direct bearing airflow to the first and second pluralities of circumferentially spaced apart first and second vent passages.

11. The aspirating face seal assembly of claim 1, wherein the primary and starter seal teeth comprise labyrinth seal teeth that sealingly engage with the primary and starter seal lands, respectively.

12. An aspirating face seal assembly operable for restricting leakage of high pressure air from a relatively high pressure region of a turbomachine to a relatively low pressure region of the turbomachine at a juncture between a non-rotatable member of the turbomachine and a rotatable member of the turbomachine, the aspirating face seal assembly comprising:

a seal teeth carrier mounted on the rotatable member, the seal teeth carrier comprising primary seal teeth that extend axially from the seal teeth carrier and starter seal teeth that extend radially outwardly from the seal teeth carrier; and an annular slider movably mounted on the non-rotatable member, wherein the annular slider comprises an annular aft extension that includes a starter seal land and a radially-extending portion that includes a primary seal land, wherein the radially-extending portion of the non-rotatable member comprises an aftwardly-extending annular ledge, and wherein the rotatable and non-rotatable members including gas bearing rotatable and non-rotatable face surfaces, respectively.

13. The aspirating face seal assembly of claim 12, further comprising:

a first plurality of circumferentially spaced apart first vent passages extending through the radially-extending portion of the annular slider;

a second plurality of circumferentially spaced apart second vent passages extending through the radially-extending portion of the annular slider, wherein the second plurality of circumferentially spaced apart second vent passages extend through the aftwardly-extending annular ledge.

14. The aspirating face seal assembly of claim 13, further comprising deflector seal teeth mounted on the seal teeth carrier.

15. The aspirating face seal assembly of claim 14, wherein the deflector seal teeth extend axially aftward from the seal teeth carrier and are oriented to direct bearing airflow from a gas bearing space extending axially between the non-rotatable and rotatable face surfaces.

16. The aspirating face seal assembly of claim 12, wherein the annular slider is biased away from a rotatable face surface of the seal teeth carrier by a pull-off biasing member positioned radially outwardly of the annular slider.

17. The aspirating face seal assembly of claim 12, further comprising a drain assembly for preventing oil from flowing into the aspirating face seal assembly.

18. The aspirating face seal assembly of claim 17, further comprising an annular oil dam depending from an aft or downstream end of the non-rotatable member and located upstream or forward of the aspirating face seal assembly.

19. The aspirating face seal assembly of claim 12, wherein the primary and starter seal teeth comprise labyrinth seal teeth that sealingly engage with the primary and starter seal lands, respectively.

* * * * *